United States Patent [19]

Jurinak

[11] 4,432,282

[45] Feb. 21, 1984

[54] PRINTING PRESS

[75] Inventor: Edward L. Jurinak, Prospect Heights, Ill.

[73] Assignee: Apollo Label Company, Worth, Ill.

[21] Appl. No.: 385,880

[22] Filed: Apr. 5, 1982

[51] Int. Cl.[3] ..... B41F 31/04; B41F 31/06

[52] U.S. Cl. ..... 101/350; 101/169

[58] Field of Search ..... 101/363, 364, 366, 350, 101/349, 207, 208, 210, 365, 148, 355, 356, 360, 361, 157, 169, 49, 51, 204, 315, 321, 326, 330, 331, 340, 341, 344, 345, 347, 351, 357

[56] References Cited

U.S. PATENT DOCUMENTS

| | | | |
|---|---|---|---|
| 194,218 | 8/1877 | Campbell | 101/364 |
| 1,469,544 | 10/1923 | Swaim | 101/364 |
| 2,232,274 | 2/1941 | Robbins | 101/363 |
| 3,613,578 | 10/1971 | Heurich | 101/350 |
| 4,127,067 | 11/1978 | Dahlgren | 101/148 |
| 4,158,333 | 6/1979 | Navi | 101/363 |
| 4,301,730 | 11/1981 | Heurich et al. | 101/426 |

*Primary Examiner*—J. Reed Fisher
*Attorney, Agent, or Firm*—Norman Lettvin

[57] ABSTRACT

A letterpress printing press is provided using an anilox form roller, to directly receive by gravity thereon, a viscous ink from an ink supply in ink fountain means that are positioned immediately above the form roller. The ink is of the type to be substantially immediately dried by being exposed to ultraviolet light. So as to control the amount of ink delivered from the anilox form roller to a printing plate, there is provided a doctor blade means located within the ink fountain means. The doctor blade means includes both a vertically slidable plate, whose vertical position is selectively controllable by means operatively associated with the plate and fountain, and a doctor blade that is cantilevered from the vertically slidable plate so as to have its relatively unsupported, and relatively flexible, free edge engage the surface of the anilox form roller to scrape excess ink from the form roller and restoring the removed ink to the ink supply in the ink fountain means.

13 Claims, 6 Drawing Figures

PRINTING PRESS

FIELD OF THE INVENTION

This invention relates to an improvement in printing presses, and more particularly relates to an improvement in a letterpress type printing machine that prints with a relatively viscous ink that is dried by being cured through exposure to ultraviolet light.

BACKGROUND OF THE INVENTION

It has been intended to provide a letterpress type printing machine using a relatively viscous ink which, after being applied to the printed web or sheet, is quickly dried by being cured through exposure to ultraviolet light. Such a machine is sold by Arpeco Engineering Ltd., 5265 Creekbank Road, Mississauga, Ontario, Canada.

In such a prior art letterpress, the system provides, among other features, an upright ink fountain that delivers ink, under gravity, onto and across the width of a rubber form roller. The said roller uses a relatively soft rubber surface having a hardness reading of about 50 Shore A durometer reading, measured on the rubber hardness scale. A doctor blade was provided, set at an angle of 90 degress to the roller's surface so as to be adapted to be selectively advanced radially of the axis of the roller, with the purpose and intent of indenting the surface of the rubber roller to an extent sufficient to control the thickness of the ink that was carried by and on the surface of the rubber roller past the indenting edge of the doctor blade.

Practical experience with the foregoing machine, which is known as a letterpress printing press, had established that during high speed operations, the rubber form roller for the ink would burn up, causing destruction of the roller and requiring substantial down time for the machine to permit substitution of a new roller for the destroyed roller. Additionally, it was observed that the ink could not be properly metered consistently for the intended result, and the rubber roller could not be maintained properly for its intended life while operating at maximum intended production rate. Alternatively, such a machine was required to be operated at less than maximum production speed, which meant that the per unit cost of production of the printed material was substantially increased.

It was also observed that the color of the printed material on different copies of a batch of printed copies would vary, which was undesirable.

In an attempt to correct the deficiencies in the machine, as are noted above, it was postulated that the burn up, or destruction, of the rubber form roller was being caused by the development of heat at the surface and in the body of the rubber roller, resulting from an energy loss brought about by the doctor blade being required to indent the rubber surface moving at a relatively high speed; and that such heat could not be properly dissipated when the printing press was to be operating at its intended high output rate.

It was further postulated that use of a rubber roller as a form roller, coupled with a doctor blade as above described, failed to provide a system that could accurately meter ink delivered to the printing plate on a consistent basis for all production speeds of the machine.

It was further postulated that the ink was being so churned, or affected, within the ink fountain by the movement of the rubber form roller and/or by the interaction of said form roller and doctor blade, that the viscosity of the ink was being altered locally to an extent sufficient to effect color change in the layer of ink being deposited from the rubber form roller onto the printing plate and thence onto the work.

It was, therefore, decided to redesign the aforesaid machine, and to improve such machine, so as to avoid the said problems incident to usage of the existing machine.

One object of this invention is to provide an arrangement which permits a printing press of the type described to function properly at all speeds including maximum speed, whereby the per unit cost of production of printed material could be reduced, and the cost effectiveness of the printing press could be optimized.

Another object of this invention is to provide, in a printing press, an improved means for transferring to the printing plate only a desired amount of printing ink that is to be dried by exposure to ultraviolet light.

A further object of this invention is to provide, in a printing press, an improved means for transferring from an ink fountain, and for transporting by roller, only a desired amount of printing ink for use with the type of printing machine disclosed, so as to avoid the problems of producing printed material with variations in the color of the print thereof.

Further objects and advantages of this invention will be made known to persons skilled in the art, through the following specifications which describe and disclose my invention.

BRIEF SUMMARY OF THE INVENTION

An ink that is dried by exposure to ultraviolet light is supplied from an ink fountain to the surface of a form roller which is constructed and arranged to transfer an ink film, only of controlled thickness, to a printing plate carried by a high speed printing cylinder. The control of the thickness of the ink film, transferred from the form roller to the printing plate, is effected through use of a combination of an anilox roller and a doctor blade that is constructed and arranged to properly control the amount of ink that passes the doctor blade, without effecting a destructive heating of the form roller, and with the control by the doctor blade, as to ink carried by the form roller, being effective to restore within the ink fountain the excess ink deposited on the roller, leaving the anilox character of the form roller free to deposit only a quiescent layer of ink onto the printing plate.

In the preferred form of the invention, the doctor blade cooperates with a portion of the upwardly moving surface of the form roller, which has had ink applied thereto from an ink fountain and which during its upward movement is located above a trace of the horizontal plane through the axis of the form roller, so as to effectively control the thickness of the ink layer that can be available for transfer from the form roller to a print applying surface, such as a printing plate. The limiting of the amount of ink available for transfer from the form roller is effected both by the nature of the roller and by a doctor blade that is inclined relative to vertical and that has a shape which effectively engages and skims excess ink from the said upwardly moving surface of the form roller.

In a preferred form, of the invention, the extended end of the doctor blade which contacts the anilox roller is cantilevered from its support to press against the surface of the anilox roller with limited but resilient pressure that is sufficient to effect removal of excess ink from the form roller's surface without damage to the form roller by frictional heating of the roller, or alteration of the ink by churning of the ink that remains in the ink releasing recesses of the anilox roller. In a preferred construction the anilox roller has a ceramic surface.

The invention will be better understood by reference to the attached drawing and the following description of a preferred embodiment of the invention, which are addressed to persons skilled in the art of printing presses.

DETAILED DESCRIPTION OF THE DRAWINGS

A. Description of the Prior Art

Figure 1:
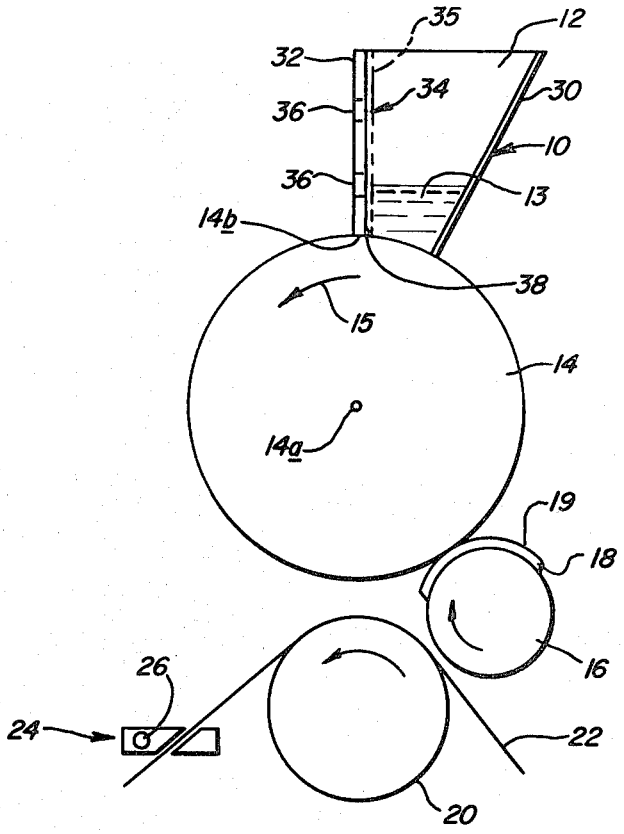
FIG. 1 PRIOR ART
FIG. 1 is an illustrative and diagrammatic fragmentary side elevational view of the related portions of a printing press of the type involved in this invention, and showing the prior art construction which resulted in destruction of the rubber form roller, as related hereinabove.

Referring now to the drawings, FIGS. 1 illustrates the basic layout of a rotary letterpress printing press, including an upright, hopper-type, ink fountain, generally 10, whose walls surround a reservoir chamber 12 in which a supply of relatively viscous printing ink 13 is stored. The ink has the character to flow by gravity from the fountain 10 onto the surface of a roller therebeneath. Located below the lower, outlet end, of inking fountain 10 is a large diameter form roller 14, which in prior art machines was provided with a rubber periphery of relatively soft rubber, having a hardness reading of about 50 Shore A durometer reading, measured on the rubber hardness scale. The roller 14 is driven, by means not shown, but well known in the art, to rotate in a counterclockwise direction, as indicated by arrow 15, as viewed in FIG. 1. A plate cylinder 16 with a printing plate 18 thereon is positioned in a manner to have the printing surface 19 of printing plate 18 inked by tangential contact with the inked surface of form roller 14. An impression roller 20 serves as a support for an elongated web 22 that is trained thereover and which is the substrate to receive the printed material from plate 18. After web 22 has been imprinted, the inked web is passed through an ink-drying station, generally 24, at which an ultra-violet lamp, or source, 26 functions to substantially immediately dry the ink that is imprinted on the web 22.

Figure 3:
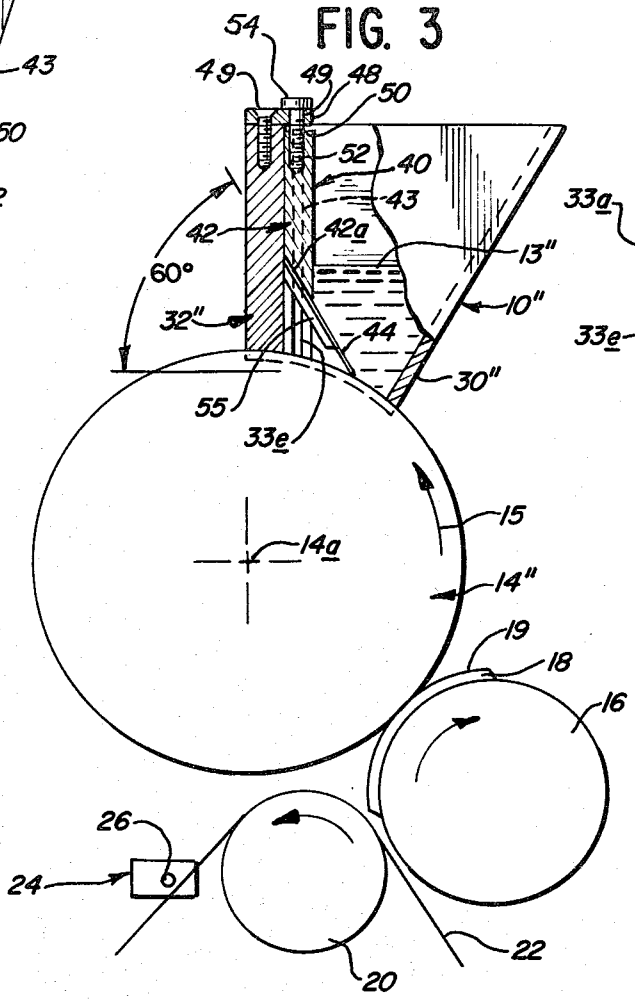
FIG. 3 is an illustrative and diagrammatic fragmentary side elevational view, similar in certain respects to FIG. 1, but showing the improvements of this invention which cause the improved printing press to function properly and in accord with the objects of this invention.

The machine of FIG. 1 was intended to operate at high speed. However, that objective was not achieved for reasons set forth above. By gearing, not shown but well known in the art, that is operatively associated with drive shafts for rollers 14, 16, and 20, the rollers are caused to rotate synchronously, in precisely timed relation to each other, with form roller 14 and impression roller 20 rotating counterclockwise, and plate roller rotating clockwise, as seen in FIGS. 1 and 3.

The fountain 10 includes an inclined upright front wall 30 and a vertical rear wall, generally 32, whose ends are overlain, and appropriately joined, by a pair of spaced end walls which cooperate with walls 30 and 32 to surround and define the interior 12 of fountain 10. The axial length of fountain 10, is so related to the axial length of form roller 14, that the ink 13 in reservoir chamber 12 contacts and will be applied to roller 14 over substantially its entire axial length. The lower edges of the fountain's walls 30 and 32, and of the end walls not shown, were intended to cooperate with the rubber surface of roller 14 to prevent leakage, but in fact there existed spacing of the parts so that leakage of ink did occur between the lower edges of the fountain's walls and the surface of roller 14. Thus, ink would seep onto the surface of roller 14 from beneath the lower edge of front wall 30 and from beneath the lower edge of rear wall 32.

As seen in FIG. 1, the form roller 14 is arranged so that during its rotation, its longitudinal axis 14*a* is positioned horizontally. The surface portion of the form roller 14 that is to receive ink from ink fountain 10 is moving upwardly of and away from the trace of the horizontal plane that passes through the roller's longitudinal axis 14*a*, and toward the form roller's apex trace, located substantially at the axially extending surface line located at about 14*b*. Thus, with the arrangement described, during the rotation of form roller 14, only a portion of the surface of form roller 14 would be momentarily located in adjacency to the lower outlet from fountain 10, so that ink from the ink supply 13 therein, under force of gravity, would feed down to be applied to the surface of form roller 14. The inked surface of form roller 14 then continued, during rotation of roller 14, upwardly past the station that is adjacent the roller's apex trace and the ink on the surface of roller 14 that would pass the fountain's rear wall 32 would thereafter be transferred to the outer surface 19 of printing plate 18. In the arrangement shown, the transfer of ink from the surface of form roller 14 to the surface 19 of plate 18 takes place in a region located below the trace of the horizontal plane that passes through the roller's axis 14*a*.

In the prior art construction shown illustratively in FIG. 1, there is a doctor blade means generally 34, in the form of an elongated steel strip which extends longitudinally along a line, or run, that lies axially of roller 14, and is positioned within the reservoir chamber 12 of fountain 10 adjacent to rear wall 32. The rear wall 32 was constructed with horizontal magnet strips 36 thereon, for the intended purpose of holding steel strip 34 adjacent wall 32, and with the lowermost edge 38 of steel strip 32 beveled and positioned substantially radially of center 14*a* of roller 14, so that the beveled edge 38 would indent the rubber surface of roller 14 to control the thickness of ink passing the lower beveled doctor edge 38 of doctor blade means 34. Means (not shown) were provided for vertically adjusting the blade means 34 relative to the surface of roller 14. The use of magnet strips 36 was inadequate to hold steel strip 34 rigidly, or in a manner to avoid all movement of strip 34.

Figure 2:
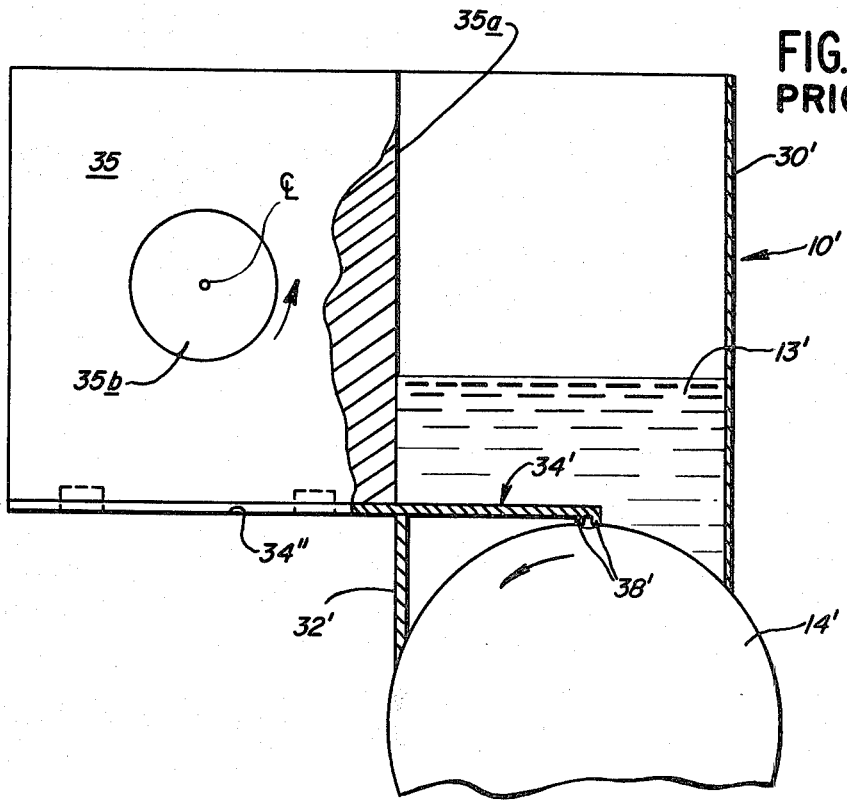
FIG. 2 PRIOR ART
FIG. 2 is another illustrative fragmentary side elevational view of another prior art construction that was unsuccessful in operation.

An eariler prior art construction, that preceded in time the construction shown in FIG. 1, is also shown diagrammatically and illustratively in FIG. 2 as including a rubber surfaced form roller 14' positioned below the lower outlet and of an ink reservoir 10' that has a supply of ink 13' therein. The ink from supply 13' feeds downwardly onto the upwardly moving surface of roller 14' that is located rearwardly of the reservoir's front wall 30'. A doctor blade mechanism 34' provided a pair of spaced, axially extending, doctor blade edges 38' that were positioned to engage the surface of roller 14', adjacent its apex trace, to operate to locally compress the rubber, as illustrated in FIG. 2, so as to control the thickness of ink film which passed below doctor blade edges 38'. The doctor blade mechanism 34' was of axial length corresponding substantially with the exposed axial length of roller 14' and was transversely elongated, as shown, to provide a wide blade shank 34' that extends from blade edges 38' over a rear wall 32' of reservoir 10' to connect to the bottom wall of a block 35. The block 35 has a forward side **35*a*, which in the position seen in FIG. 2 serves as the rear wall of reservoir 10', for aiding in confining the pool of ink 13'**.

Block 35 has shaft means **35*b* extending outwardly therefrom and from opposite sides of block 35, to be journalled in a support (not shown). By pivoting shaft 35*b* counterclockwise about its horizontal axis 35*c*, the block 35 and the attached doctor blade mechanism 34' will be swung between a position of engagement with roller 14', as seen in FIG. 2, and a position where the doctor blade edges 38' are raised from compressing engagement with the rubber surface of roller 14'. A fine manual control (not shown) was provided for effecting incremental pivotal adjustment of shaft 35*b* about its horizontal axis to select the degree of compressive engagement of blade edges 38' with the rubber surface of roller 14'. This prior art construction was not successful, and the manufacturer apparently abandoned the design of FIG. 2 for the design disclosed in FIG. 1** which also was unsuccessful.

B. Description of The Invention Disclosed Herein

Figure 4:
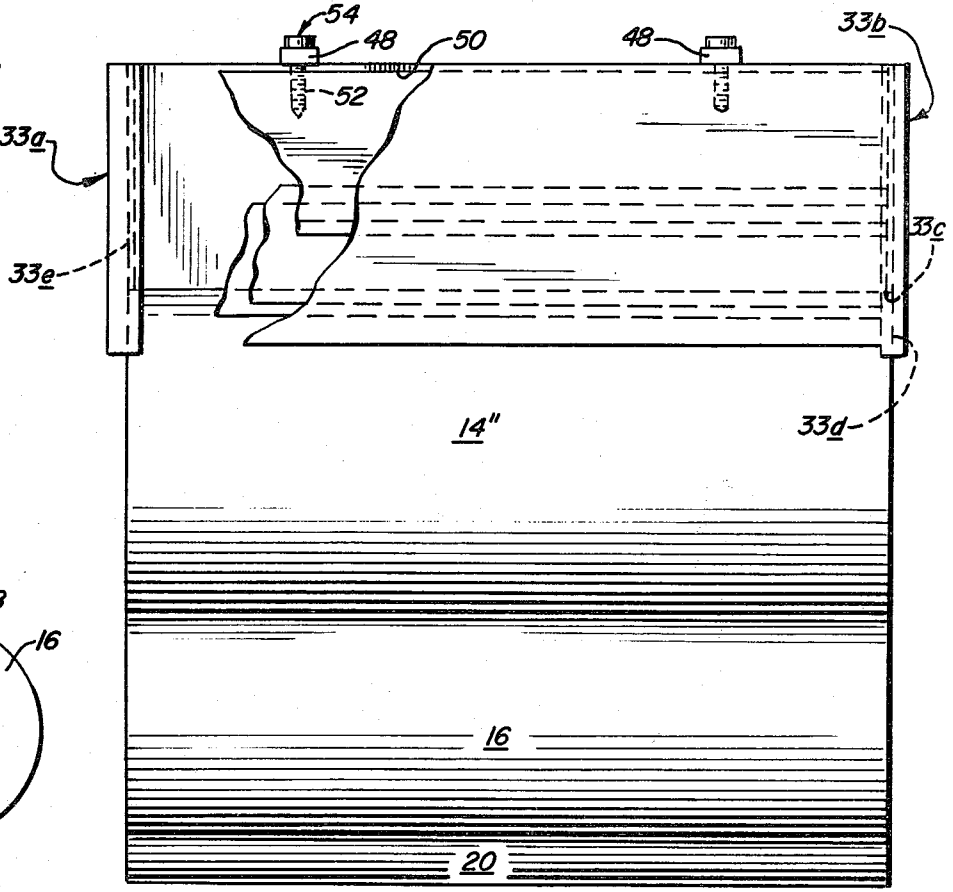
FIG. 4 an elevational view of the structure shown in FIG. 3, taken looking from the right of FIG. 3.
Figure 5:
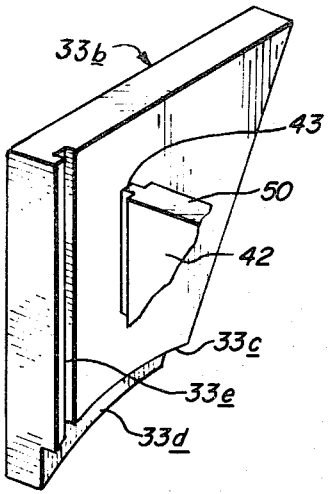
FIG. 5 is a perspective view of the ink fountain's side plate reflecting improvement features employed in the invention disclosed in FIGS. 3 and 4.

In the improved machine shown in FIGS. 3–5 of the drawings and disclosed herein, the form roller 14'' is specifically an anilox roller. An anilox roller is a device that is well known in the art, and it provides on the cylindrical surface thereof literally millions of identical microscopic pockets, or recesses, known as cells that are shaped in various forms, such as inverted pyramids, quads, round hemisphere cells or cone shaped cells or equivalents. The pockets are engraved into, and therefore lie depressed relative to, the outer surface of the roller, and they operate to carry therein, a specific volume of ink per square inch of area of the roll surface.

An anilox roller may be formed with its cylindrical surface of steel or other metal, such as chrome, or the roller surface may be a ceramic, or ceramic PTFE (polytetrafluoroethylene) coating.

In the improved machine shown in FIGS. 3–5 a ceramic-coated anilox form roller 14'' is preferred, because the coating is extremely hard, durable, and highly resistant to mechanical damage, abrasion, or corrosion. The engravings that provide the ink-carrying recesses are selected to be of a shape designed for optimum ink-carrying ability. Ceramic-coated anilox form rollers are available from a number of sources, such as CSI Corp.; Consolidated Engravers Corp. of Charlotte, N.C.; and others.

Since the ink to be dispensed from an anilox form roller is essentially carried in the multiple pockets, or recesses, in the surface of the anilox roller 14'', there is also provided in my invention an improved means for limiting the amount of ink supplied from fountain means 10'' that may be ultimately carried by the inking surface of the anilox roller 14. Toward this end there is provided, located in fountain means 10'', a doctor blade means, indicated generally at 40. Fountain means 10'' is formed by upright walls including front wall 30'', rear wall 32'', and spaced parallel end walls **33*a* and 33*b*. As will be understood from this description, the doctor blade means 40 are so dimensioned and positioned relative to the fountain means 10 as to substantially block further flow of ink from ink pool 13'' onto the portion of the surface of anilox form roller 14'' which during its rotation, has passed the lowermost blade portion of the doctor blade means 40**.

The doctor blade means 40 includes a rigid upright support wall, or plate, generally 42, located within the fountain 10, at a region forwardly of but closely adjacent to, rear fountain wall 32''. The support wall 42 is of a length, measured axially of roller 14'', such as to span the spacing, with clearance to permit free vertical movement of wall 42, between the opposed faces of the side walls **33*a* and 33*b* of the fountain. The doctor blade means 40 also includes an elongated doctor blade 44 provided in the form of an elongated steel strip that is of an axial length which is substantially the same as the axial length of the anilox roller 14''**.

A portion of end wall **33*b* is seen in perspective in FIG. 5, and end wall 33*a* is a mirror image of end wall 33*b*. Each end wall 33*a* and 33*b* is formed with an arcuate wall 33*c* that is shaped to embrace a cyclindrical edge portion of the roller 14'', and an adjacent vertical wall 33*d* that lies adjacent, and overlapping, a portion of the end wall of roller 14''. An elongated vertical groove 33*e* in the inner wall of each end wall 33*a* and 33*b* is adapted to provide for a sliding rib-and-groove connection with the support wall 42 of the doctor blade means 40**.

The said surfaces **33*c* and 33*d* are preferably coated with the product polytetrafluorethylene sold under the trademark "Teflon", or other lubricating-type synthetic coating to form a seal with surfaces of the roller 14'' to prevent ink leakage therebetween. The lower edge of front wall 30 and rear wall 32'' are also treated with Teflon to cooperate with the cylindrical surface of roller 14''** to prevent ink leakage therepast.

The doctor blade 44 is rigidly connected adjacent its rear edge thereof to the lower beveled edge **42*a* of upright wall 42, and said blade 44 projects therefrom downwardly and forwardly toward the surface of anilox roller 14 to provide a lowermost free edge 45 that points generally in a direction opposite, or reverse, to the direction of rotation of the anilox roller 14'', with the free edge 45 of blade 44 arranged to engage along a line that extends over the width of the cylindrical surface of anilox roller 14, thereby serving the doctoring function, to scrape off from the cylindrical surface of said roller any excess ink that may be deposited thereon from the fountain 10. The bevel angle of wall edge 42*a*, and the angle at which doctor blade 44 projects downwardly and forwardly from its mounting upon wall 42**, is at an included angle of about thirty degrees (30°) to vertical.

As seen in FIG. 4, a mounting structure for the doctor blade means 40 includes a pair of supports 48 that are secured to the upper edge of rear fountain wall 32'' and which project inwardly of the wall 32'' over the interior of the fountain. The supports 48 are spaced axially relative to the roller 14'' and are each rigidly secured in position by a screw connector 49 which screws into rear fountain wall 32''. Positioned below the inwardly extensions of supports 48 is the support wall 42 for the doctor blade means 40. The support wall 42 is located in a vertical plane in which the vertical grooves **33*e* of end walls 33*a* and 33*b* is located. The vertical edges of support wall 42 are each provided with a rib, or rail, 43 of lesser thickness than support wall 42, and of a thickness dimension to slidingly enter one of the pair of vertical grooves 33*e* of the end walls 33*a* and 33*b*. This rib and groove connection between wall 42 and end walls 33*a* and 33*b* operates to insure against undesired movement of the doctor blade means 40**.

The vertical size of doctor blade means 40 is designed and selected such that when doctor blade 44 is engaging the surface of anilox roller 44'', the upper edge 50 of support wall 42 is spaced below support 48, as seen in FIGS. 3 and 4. As a manual control for adjusting the pressure of doctor blade 44 against roller 14'', the wall 42 is tapped at 52 to receive therein the threaded stems of selectively manually adjustable adjustment bolts 54, whose stems are also screw connected through tapped holes 49 in supports 48.

The doctor blade 44 has its lowermost end projecting forwardly of and cantilevered from its rearward point of attachment to the bevel edge **42*a* of support wall 42. Such cantilevered mounting provides for a give or flexing of the extended edge of the doctor blade as it engages and rides along the surface of roller 14''. The contact edge of doctor blade 44 is also beveled, as seen at 45*a*, to provide an acute, or relatively sharpened edge to efficiently skim ink from the surface of roller 14''**.

To control the flexing of the extended end of doctor blade 44, a stiffener or retainer plate 55 is located below blade 44 and abutting blade 44. The stiffener plate 55, and doctor blade 44 are secured to the lower end of support wall 42 by means of machine screws which screw into tapped holes provided in support wall 42.

Figure 6:
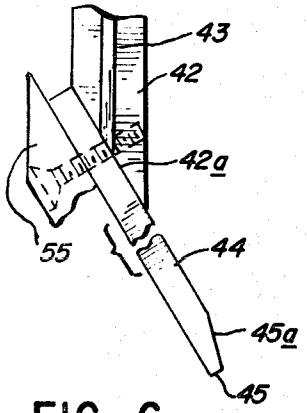
FIG. 6 is an enlarged fragmentary view of a portion of the doctor blade assemblage shown in FIG. 3.

The doctor blade 44 may, for example, be formed from a strip of steel of 2" width and thickness of 0.006 in. that has been beveled at **45*a* at the free edge thereof, to a minimum thickness of only 0.003 inches as seen in FIG. 6. The stiffener plate 54 has an effective width less than the width of blade 44, as shown in FIG. 3. This provides an unsupported cantilevered doctor blade portion, at the forwardmost edge, as shown, that is operative to engage the surface of anilox roller 14''. The angle at which doctor blade 52 is held is at an included angle of about 30 degrees to the vertical, or about 60 degress to horizontal. The downwardly inclined doctor blade 44 is constructed and positioned to engage at its forwardmost and lowermost edge with the surface of anilox roller 14, and by this arrangement the doctor blade operates to scrape off, and remove, the excess ink from the anilox roller's cylindrical surface. The location of the doctor blade, so as to engage a portion of the surface of roller 14'' only after roller 14'' has been exposed to ink within fountain 10, and at a point below and forward of the apex trace 14*b* of roller 14'' operates to return the excess ink that is removed by blade 44 from roller 14 to the ink supply pool 13'' within fountain 10. Since the doctor blade 44 and its mounting wall structure 42 extend across the entire axial width of roller 14'' and across the inner width of fountain 10, the portion of roller 14 that has had excess ink removed therefrom is then shielded from the pool of ink 13'' in ink fountain 10'', and the anilox roller 14'' emerges from beneath fountain 10''** carrying ink only in the pockets of the anilox roller.

While there has been disclosed one preferred form of my invention, persons skilled in the art will appreciate that my invention may be embodied in other arrangements. Therefore, I seek to cover the invention as limited soley in the claims appended hereto.

What is claimed and desired to be secured by Letters Patent of the United States is:

1. In a printing press for printing with an ink that is adapted to be dried by exposure to ultraviolet light, and including an ink fountain means defined in part by spaced front and rear walls and with a lower, axially elongated, end outlet for feeding said ink by gravity through said lower end outlet directly onto an axially elongated section of a rotatable anilox form roller, whose diameter is larger than the transverse size of said lower end outlet of the ink fountain means, and wherein said anilox roller is adapted, constructed, and arranged to transfer a desired layer of ink through tangent moving engagement, to a printing plate carried on a print cylinder that is rotated in synchronism with said anilox form roller; the improvement comprising, in combination:

doctor blade means, separate from and positioned between the fountain's front and rear walls, and positioned within the ink fountain means, and relative to an upper surface portion of the anilox roller that has already received ink thereonto from said fountain means, the doctor blade means being positioned so as to block further flow of ink onto that upper surface portion of the anilox roller that is adjacent said roller's apex trace region, said doctor blade means including an axially elongated, and downwardly inclined, doctor blade whose axial length is substantially the same as that of the portion of the anilox form roller which is exposed to ink that is being deposited onto the rotating form roller by said roller's exposure to the lower end outlet of the fountain means; and the axially elongated lowermost edge of said downwardly inclined doctor blade being constructed and positioned to engage the longitudinal outer surface of said rotating anilox roller, so as to remove excess ink from the anilox roller's cylindrical surface, and to return and maintain such excess ink as part of the ink supply of the fountain means.

2. A construction as in claim 1 wherein a rotating print cylinder is located so that the tangent moving engagement of the printing plate with the rotating anilox cylinder occurs at an elevation below the horizontal axial plane trace of the anilox roller.

3. A construction as in claim 1 wherein the doctor blade is shaped to provide an acute edge on the portion of the doctor blade which engages the surface of the anilox roller.

4. A construction as in claim 1 wherein the doctor blade means includes a selectively removable vertical support, and wherein the doctor blade is inclined downwardly and projecting from said support oppositely to the direction of rotation of the anilox roller.

5. A construction as in claim 1 wherein the ink fountain means includes a pair of parallel, spaced, end walls which are constructed and shaped to embrace cylindrical and end portions of the anilox roller.

6. A construction as in claim 5 wherein portions of the end walls of the ink fountain means, which are immediately adjacent any portion of the anilox roller onto which ink is deposited, are coated with polytetrafluoroethylene to provide means for limiting leakage of ink past the interface between the anilox roller and the ink fountain means.

7. A construction as in claim 5 wherein the end walls of the ink fountain means are provided with a pair of upright grooves to provide a track means along which the doctor blade means is arranged to be movable to accommodate selective vertical adjustment of the doctor blade means relative to the anilox roller.

8. A construction as in claim 7 wherein supports are provided on an upper portion of the ink fountain means projecting inwardly of the walls of the ink fountain means, and screw type controls being operatively associated with said supports and with the doctor blade means to provide for selective manual vertical control of the doctor blade means relative to the anilox roller.

9. A construction as in claim 1 wherein the anilox roller has a ceramic cylindrical surface.

10. A construction as in claim 1 wherein the ink fountain means includes:

a pair of parallel end walls positioned adjacent the ends of the form roller and having upright slideway means provided thereon;

the doctor blade means including an upright wall having slide portions thereon operatively associated with said slideway means on the end walls of the fountain means; and the cooperation of the slide portions of the upright wall with the upright slideway means on the fountain means operating to avoid undesired movement of the doctor blade means relative both to the fountain means and to the anilox form roller.

11. A construction as in claim 10 wherein the doctor blade portion of the doctor blade means is cantilevered from said upright wall free from engagement with the ink fountain means.

12. A construction as in claim 10 wherein selectively adjustable control means are provided, supported on the ink fountain means and operatively connected to the upright wall of the doctor blade means, for selectively adjusting the position of the doctor blade means along the upright slideway means on the fountain means.

13. A construction as in claim 11 including selectively adjustable control means that are operatively associated with the upright wall of the doctor blade means for varying the force with which the lowermost edge of the doctor blade engages the cylindrical surface of the anilox roller.

* * * * *